US006299409B1

(12) United States Patent
Matsunaga et al.

(10) Patent No.: US 6,299,409 B1
(45) Date of Patent: Oct. 9, 2001

(54) CENTRIFUGAL TYPE BLOWER UNIT

(75) Inventors: Kouji Matsunaga, Kariya; Teruhiko Kameoka, Okazaki; Koji Ito, Nagoya; Tohru Tanaka, Kariya; Yasushi Mitsuishi, Okazaki, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/286,002

(22) Filed: Apr. 5, 1999

(30) Foreign Application Priority Data

Apr. 10, 1998 (JP) ..... 10-099364
Feb. 1, 1999 (JP) ..... 11-024093

(51) Int. Cl.[7] ..... F04D 17/08

(52) U.S. Cl. ..... 415/206; 415/119; 415/204; 415/208.1; 415/211.1; 415/173.6; 416/183; 416/186 R; 416/189; 416/192; 416/223 B

(58) Field of Search ..... 415/206, 119, 415/204, 211.1, 208.1, 173.6, 173.1, 228; 416/183, 185, 186 R, 189, 192, 223 B

(56) References Cited

U.S. PATENT DOCUMENTS 4,363,601 * 12/1982 Leskinen ..... 416/188
4,432,964 * 2/1984 Kuroda et al. ..... 415/170 A
5,813,831 * 9/1998 Matsunaga et al. ..... 415/173.6
5,911,751 * 6/1999 Kim ..... 62/407
5,971,709 * 10/1999 Hauser ..... 416/175

FOREIGN PATENT DOCUMENTS 2-5-38877 6/1993 (JP) .
5-321891 12/1993 (JP) .
9-126190 5/1997 (JP) .

* cited by examiner

*Primary Examiner*—Christopher Verdier
(74) *Attorney, Agent, or Firm*—Harness, Dickey & Pierce, PLC

(57) ABSTRACT

In a centrifugal type blower unit, a diameter of an air suction port is set to be larger than a minimum inner diameter of a centrifugal fan, and a slanting portion is formed in each blade of the centrifugal fan at a side of the air suction port so that an inner radius dimension of the centrifugal fan is increased toward the air suction port. Therefore, it can prevent sub-flow air which is sucked into the centrifugal fan from an end side of the blades in an axial direction from interfering with main-flow air which is sucked into the centrifugal fan from an inner radius side of the blades. Thus, the blower unit can reduce second noise generated therefrom without greatly reducing air-blowing capacity.

28 Claims, 14 Drawing Sheets

CENTRIFUGAL TYPE BLOWER UNIT

CROSS-REFERENCE TO RELATED APPLICATION

This application relates to and claims priority from Japanese Patent Application No. Hei. 10-99364 filed on Apr. 10, 1998, and No. Hei. 11-24093 filed on Feb. 1, 1999, the contents of which are hereby incorporated by reference.

BACKGROUND OF THE INVENTION

1. Field of the Invention

The present invention relates to a centrifugal type blower unit which reduces noise generated therefrom without greatly reducing air-blowing capacity. The blower unit is suitable for a vehicle air conditioner.

2. Description of Related Art

In a conventional blower unit, noise (hereinafter referred to as "first noise") may be generated when air blown from a centrifugal fan collides with a nose portion of a scroll casing. The first noise is approximately proportional to a rotation speed of the centrifugal fan and number of blades of the centrifugal fan. Therefore, in the conventional blower unit, the shape of the nose portion is suitably formed so that the first noise can be decreased.

However, according to an experiment of the inventors of the present invention, noise (hereinafter referred to as "second noise") having a frequency approximately similar to the first noise is also generated in the conventional blower unit where a filter is disposed at an air suction port of the centrifugal fan. To reduce the second noise, the inventors of the present invention experimentally perform the method for reducing the first noise. However, the second noise cannot be sufficiently reduced by using the method for reducing the first noise.

SUMMARY OF THE INVENTION

To overcome the problems, the inventors of the present invention studied the reason why the second noise is caused. As shown in FIG. 22, in a centrifugal fan, air is concentrated to an inner radius side while being whirled, is sucked into an air suction port, and is blown radially outwardly by centrifugal force. However, as shown in FIG. 22, because the diameter of the air suction port is made larger than the inner diameter of the centrifugal fan to increase air-blowing amount, air can be sucked from both inner radius side of the centrifugal fan and an end side of blades at a side of the air suction port. Air (i.e., sub-flow air ) sucked from the end side of blades has a small kinetic energy, as compared with air (i.e., main-flow air) sucked from the inner radius side of the centrifugal fan. Therefore, when the sub-flow air is mixed into the main-flow air, unstable whirl may be generated at the end side of the blades. That is, an interference between the sub-flow air and the main-flow air is caused, and the second noise is caused. Thus, the second noise may be generated even though the filter is not provided at the air suction port. For reducing the second noise, a bell-mouth portion forming the air suction port may extend toward a radius inner side to cover the ends of blades. In this case, the second noise is decreased, as shown in FIG. 23. However, air amount (air capacity) blown by the blower unit is greatly decreased, as the diameter of the air suction port reduces, as shown in FIG. 23.

In view of the foregoing problems, it is a first object of the present invention to provide a centrifugal type blower unit which reduces second noise generated therefrom without greatly reducing air-blowing capacity.

It is a second object of the present invention to provide a centrifugal type blower unit which can reduce both second noise and low-frequency noise without greatly reducing air-blowing capacity.

According to the present invention, in a centrifugal type blower unit, an air suction port for sucking air from an axial direction of a centrifugal fan has a radius dimension in a radius direction of the centrifugal fan, and the radius dimension of the air suction port is larger than a minimum inner radius dimension of the centrifugal fan in the radius direction. A slanting portion slanted relative to the radius direction by a predetermined slanting angle is formed in each blade of the centrifugal fan in such a manner that an inner radius dimension of the centrifugal fan in the radius direction is increased toward the air suction port. Further, a constant portion connected to the slanting portion is formed in each blade of the centrifugal fan to be approximately parallel to the axial direction. Thus, it can prevent sub-flow air which is sucked into the centrifugal fan from an end side of the blades at the side of the air suction port from interfering with main-flow air. That is, the sub-flow air is sucked into the inner radius side of the centrifugal fan together with main-flow air. As a result, the blower unit can reduce second noise. Further, because the diameter of the air suction port is larger than the minimum inner diameter of the centrifugal fan, it can prevent air-blowing capacity of the blower unit from being decreased. Thus, the blower unit reduces second noise generated therefrom without greatly reducing air-blowing capacity.

Preferably, the slanting angle is in a range of 25°–80°. Therefore, sub-flow air is readily concentrated into the inner radius side of the centrifugal fan together with main-flow air, so that the interference between main-flow air and sub-flow air can be prevented. Thus, the second noise can be readily restricted.

More preferably, a bell-mouth portion for forming the air suction port has a covering member for covering the slanting portion, and the covering member extends to a radius inner side of the centrifugal fan in the radius direction. Therefore, an interference between suction air sucked from the air suction port and back-flow air can be prevented so that low-frequency noise of the blower unit can be decreased, while the second noise of the blower unit is decreased.

Still more preferably, the covering member is formed at a predetermined position corresponding to a noise portion of a scroll casing. Therefore, the blower unit of the present invention can decrease both the second noise and the low-frequency noise without greatly reducing air-blowing capacity.

Further, each of the blades has a first end at a radius inside and a second end at a radius outside of the first end. Each of the blades has a first curvature radius at a side of the first end, and a second curvature radius at a side of the second end. In each blade of the centrifugal fan, the first curvature radius is smaller than the second curvature radius. Thus, consumption power of the blower unit can be decreased, while noise generated from the blower unit is decreased.

Preferably, the first curvature radius is for a first area of each blade, from the first end to about ¼ position of a blade length in the radius direction. Therefore, consumption power of the blower unit can be further decreased, while noise generated from the blower unit is decreased.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention are described hereinafter with reference to the accompanying drawings.

Figure 1:
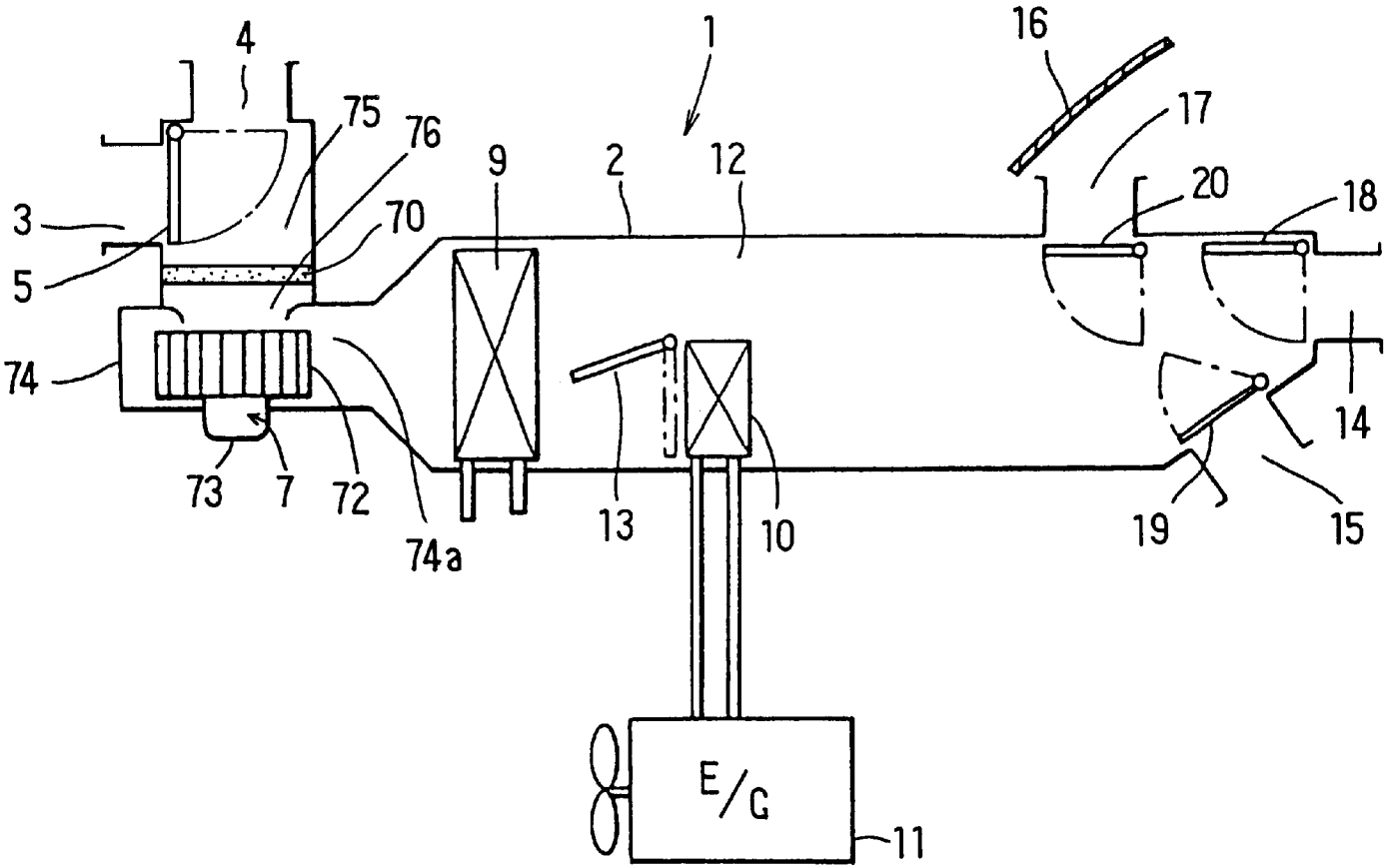
FIG. 1 is a schematic diagram showing an air conditioner for a vehicle according to a first preferred embodiment of the present invention.

A first preferred embodiment of the present invention will be described with reference to FIGS. 1–6. In the first embodiment, as shown in FIG. 1, a centrifugal type blower unit 7 is typically used for an air conditioner 1 disposed in a vehicle. The air conditioner 1 includes an air conditioning case 2 forming an air passage, an inside air suction port 3 for introducing inside air (i.e., air inside a passenger compartment) and an outside air suction port 4 for introducing outside air (i.e., air outside the passenger compartment) are formed in the air conditioning case 2 at an upstream air side. The inside air suction port 3 and the outside air suction port 4 are opened and closed by a switching door 5 rotatably held in the air conditioning case 2. The switching door 5 is rotated by an actuator such as a servomotor or is rotated manually by a passenger in the passenger compartment of the vehicle.

The blower unit 7 is disposed in the air conditioning case 2 at a downstream side of the switching door 5, so that air introduced from the air suction ports 3, 4 is blown by the blower unit 7 into the passenger compartment through air outlets 14, 15, 17 described later. A filter 70 is disposed in the air conditioning case 2 at an upstream air side of the blower unit 7, between the switching door 5 and the blower unit 7. An evaporator 9 for cooling air passing therethrough is disposed in the air conditioning case 2 at a downstream side of the blower unit 7, and all air blown from the blower unit 7 passes through the evaporator 9. A heater core 10 for heating air passing therethrough is disposed in the air conditioning case 2 at a downstream side of the evaporator 9. The heater core 10 heats air using cooling water of an engine 11 as a heating source.

The heater core 10 is disposed in the air conditioning case 2 so that a bypass passage 12 through which air having passed through the evaporator 9 bypasses the heater core 10 is formed. An air mixing door 13 for adjusting a ratio between an amount of air passing through the heater core 10 and an amount of air passing through the bypass passage 12 is disposed between the evaporator 9 and the heater core 10, so that the temperature of air blown into the passenger compartment can be controlled. In the first embodiment, by adjusting a rotation position of the air mixing door 13, the amount of air passing through the heater core 10 and the amount of air passing through the bypass passage 12 are adjusted.

At a most downstream side in the air conditioning case 2, there are provided with a face air outlet 14 for blowing conditioned air toward the upper portion of a passenger in the passenger compartment, a foot air outlet 15 for blowing conditioned air toward the foot portion of the passenger in the passenger compartment, and a defroster air outlet 17 for blowing air toward an inner surface of a front windshield 16. A mode switching door 18 for opening and closing the face air outlet 14 is disposed at an upstream side of the face air outlet 14, a mode switching door 19 for opening and closing the foot air outlet 15 is disposed at an upstream side of the foot air outlet 15, and a mode switching door 20 for opening and closing the defroster air outlet 17 is disposed at an upstream side of the defroster air outlet 17. The mode switching doors 18, 19, 20 are rotated by an actuator such as a servomotor, or are rotated manually by the passenger in the passenger compartment. In the air conditioner 1, because each opening area of the foot air outlet 15 or the defroster air outlet 17 is made smaller than that of the face air outlet 14, pressure loss (air flow resistance) in the ventilation system of the air conditioner 1 becomes larger during a foot mode or a defroster mode, as compared with a face mode.

Figure 2:
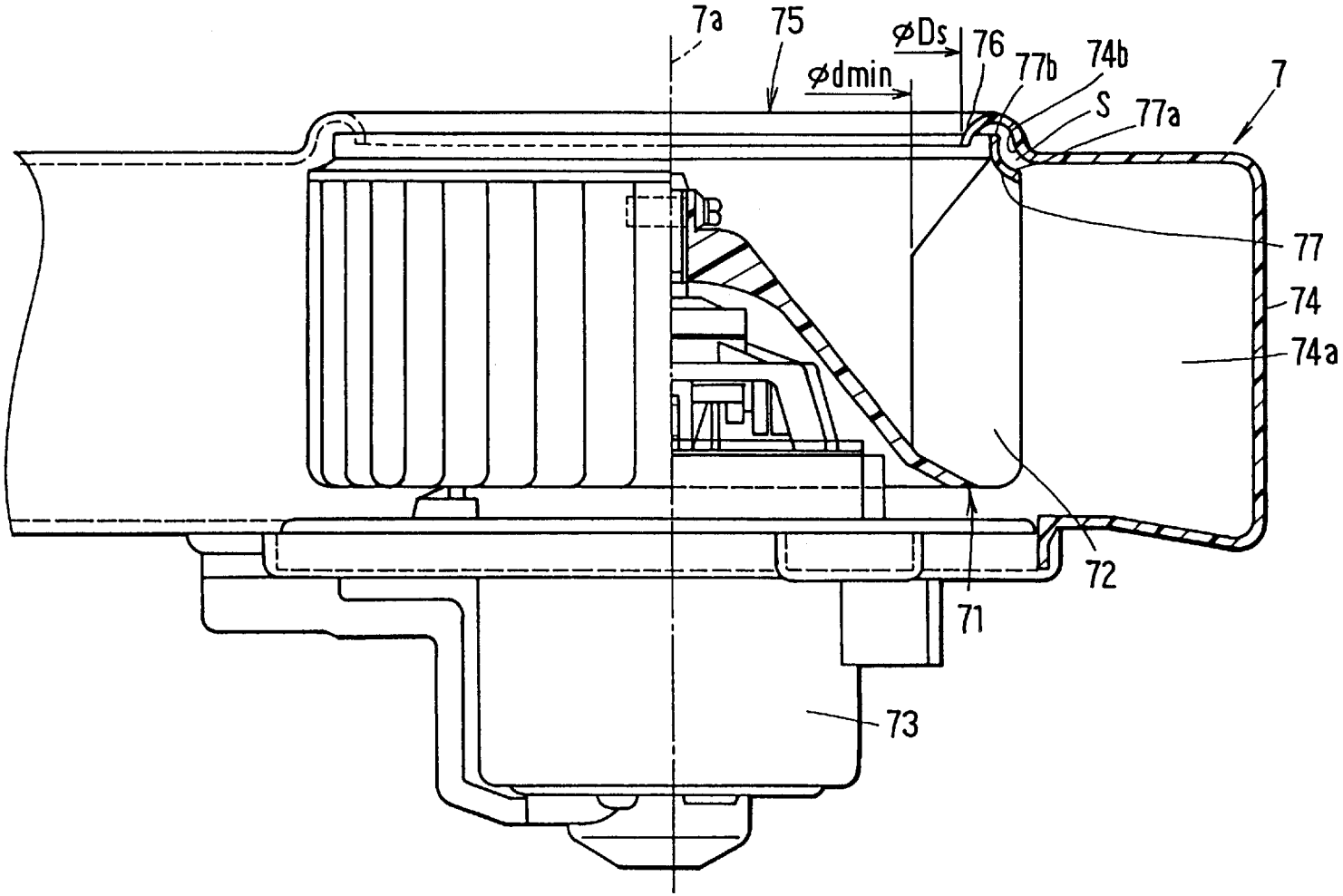
FIG. 2 is a schematic sectional view in an axial direction, showing a centrifugal type blower unit according to the first embodiment.
Figure 3:
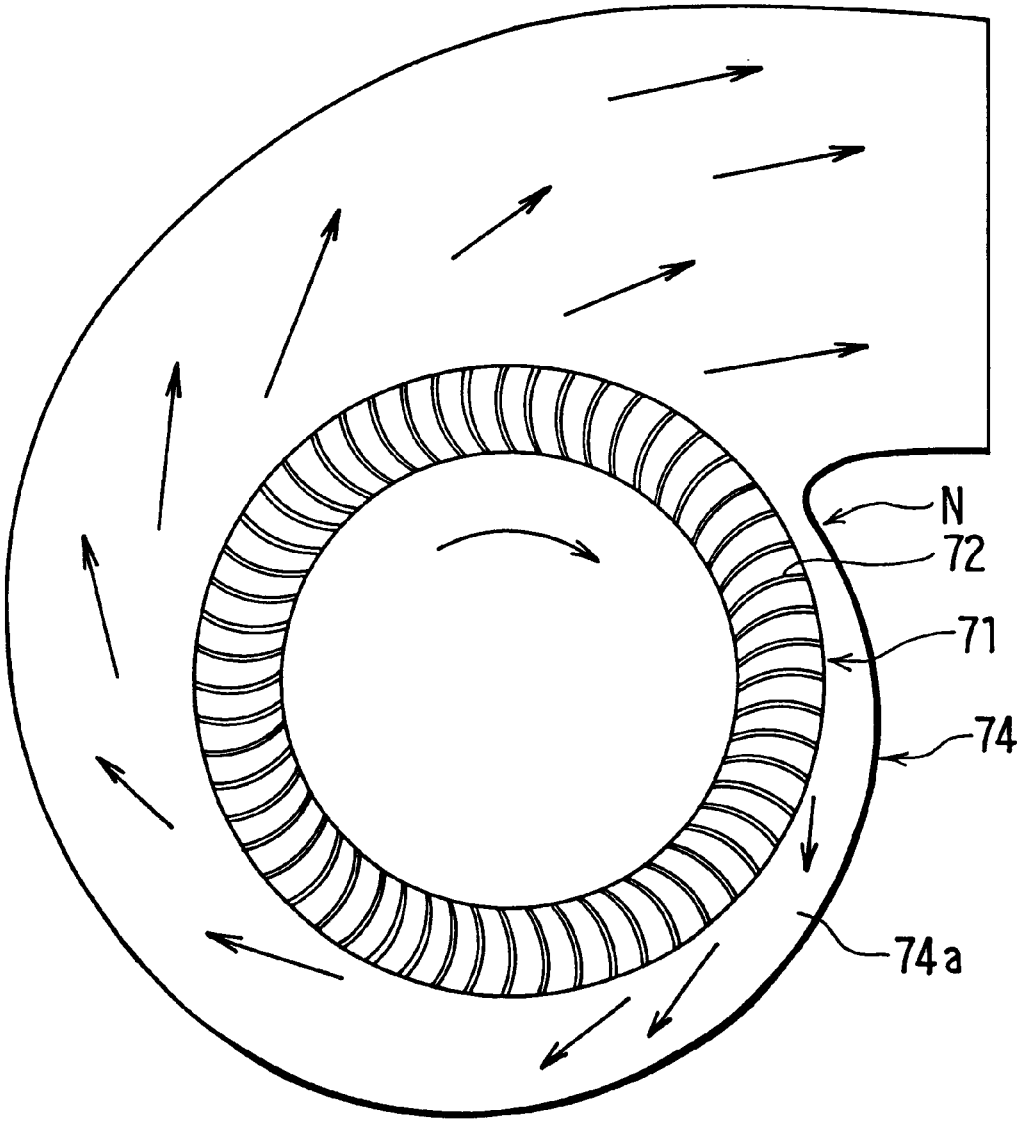
FIG. 3 is a schematic sectional view in a radius direction vertical to the axial direction, showing the blower unit according to the first embodiment.

Next, the blower unit 7 will be now described in detail. As shown in FIG. 2, the blower unit 7 includes a centrifugal multi-blades fan 71 which sucks air from an axial end side of a rotation axis 7*a* and blows the sucked air radially outwardly, and an electric motor 73 for driving and rotating the centrifugal fan 71. The centrifugal fan 71 has a plurality of blades 72 disposed around the rotation axis 7*a*. As shown in FIG. 3, the centrifugal fan 71 is accommodated in a scroll casing 74 forming an air passage 74*a* through which air blown from the centrifugal fan 71 flows. The scroll casing 74 is made of resin, and is formed into a spiral shape. An air suction port 75 having a diameter Ds is formed in the scroll casing 74 to be opened toward the axial end side of the rotation axis 7*a*, opposite the electric motor 73. The diameter Ds of the air suction port 75 is set to be larger than a minimum inner diameter $d_{min}$ of the blades 72 (fan 71). That is, a bell-mouth portion 76 forming the air suction port 75 is positioned at a radius outside of a most inner radius end of the blades 72 relative to the rotation axis 7*a*. The bell-mouth portion 76 is formed integrally with the scroll casing 74 at the air suction port 75

Figure 4:
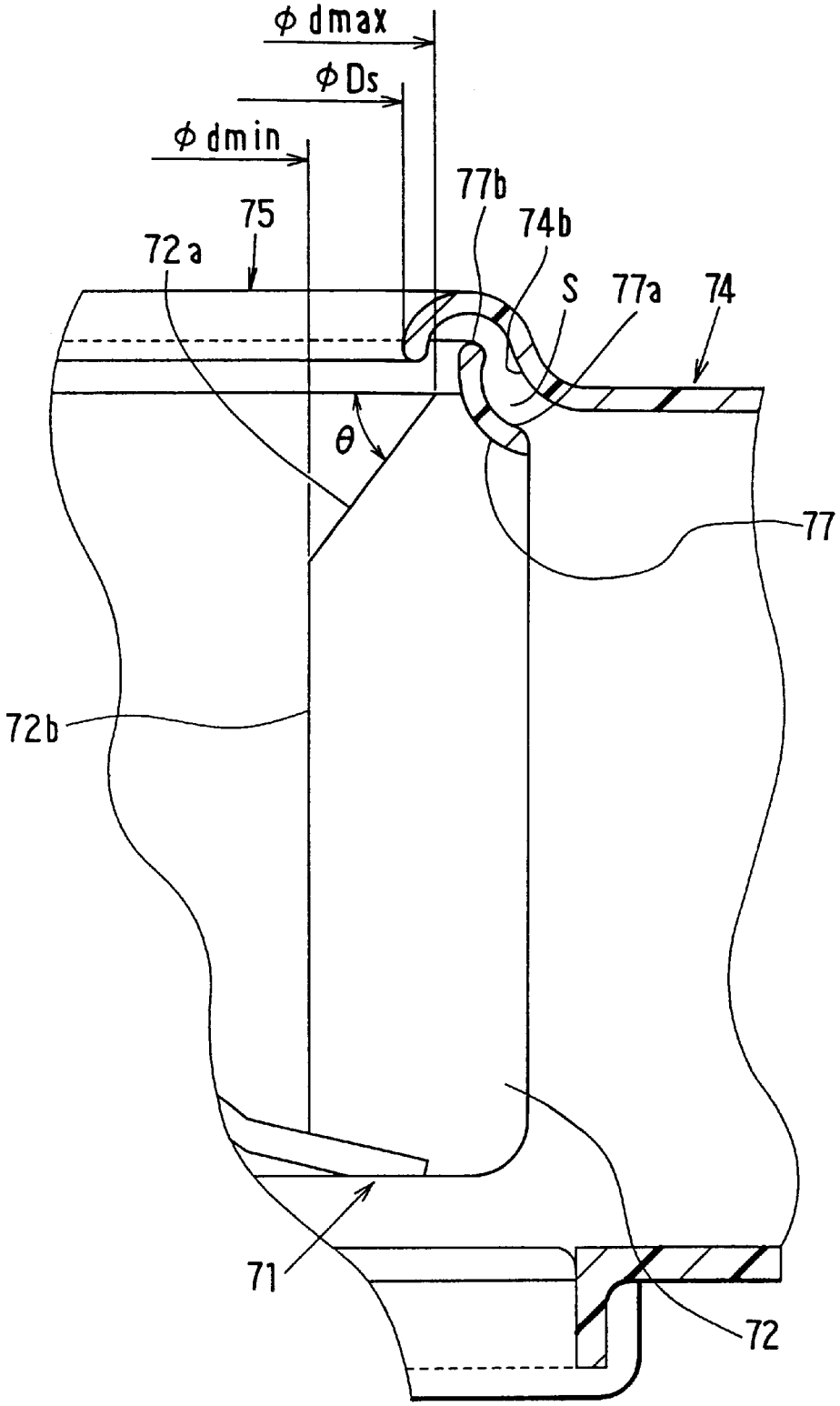
FIG. 4 is an enlarged view showing a part of the blower unit according to the first embodiment.

In the first embodiment, as shown in FIG. 4, a shroud 77 is formed integrally with each of the blades 72 using resin. The shroud 77 has a shrouded surface 77*a* which is opposite to an inner wall 74*b* of the scroll casing 74 to have a clearance S between the inner wall 74*b* and the shrouded surface 77*a*. The shroud 77 is formed approximately into a circular arc shape in cross section along a flow line of main flow of air passing through between the blades 72, so that a sectional area of an air passage within the centrifugal fan 71 is reduced from a radius inner side toward a radius outer side by the shroud 77. That is, at the position where the shroud 77 is formed, a height of each blade 72 is gradually reduced toward the radius outside, as shown in FIG. 4.

Further, the shroud 77 has an extending portion 77*b* extending from each end of the blades 72 at the side of the air suction port 75 to the air suction side in the axial direction of the rotation axis 7*a*. The bell-mouth portion 76 extends toward a radial inner side to cover the extending portion 77*b* of the shroud 77.

As shown in FIG. 4, a slanting portion 72*a* linearly slanted relative to the radius direction of the centrifugal fan 72 by a slanting angle θ (e.g., 50°, in the first embodiment) is formed in each blade 72 at the side of the air suction port 75 so that the inner diameter of the centrifugal fan 71 is gradually increased toward the side of the air suction port 75. Further, a parallel portion 72*b* parallel to the rotation axis 7*a* is formed in each blade 72 of the centrifugal fan 71 to be connected to the slanting portion 72*a*, so that parallel portion 72*b* of the centrifugal fan 71 has a constant inner diameter equal to the minimum inner diameter $d_{min}$.

In the first embodiment, the maximum inner diameter $d_{max}$ of the centrifugal fan 71 at the side of the air suction port 75 is set to be approximately 1.06 times of the opening diameter Ds of the air suction port 75. That is, a ratio of the maximum inner diameter $d_{max}$ of the centrifugal fan 71 to the opening diameter Ds of the suction port 75 is approximately 1.06. The maximum inner diameter $d_{max}$ of the centrifugal fan 71 is an inner diameter on an end of the slanting portion $72_a$ at the side of the air suction port 75.

According to the first embodiment of the present invention, the slanting portion 72*a* is formed on the inner radius ends of the blades 72 of the centrifugal fan 71 at the side of the air suction port 75, sub-flow air can also be introduced into the inner radius side of the centrifugal fan 71 together with main-flow air. Therefore, an interference between the main-flow air and the sub-flow air can be prevented, and the second noise generated from the interference between the main-flow air and the sub-flow air can be restricted.

Further, because the opening diameter Ds of the air suction port 75 is set to be larger than the minimum inner diameter $d_{min}$ of the centrifugal fan 71, the centrifugal fan 71 has a sufficient air-blowing capacity. That is, according to the first embodiment of the present invention, the blower unit 7 can reduce the second noise without greatly reducing the air-blowing capacity.

Figure 5:
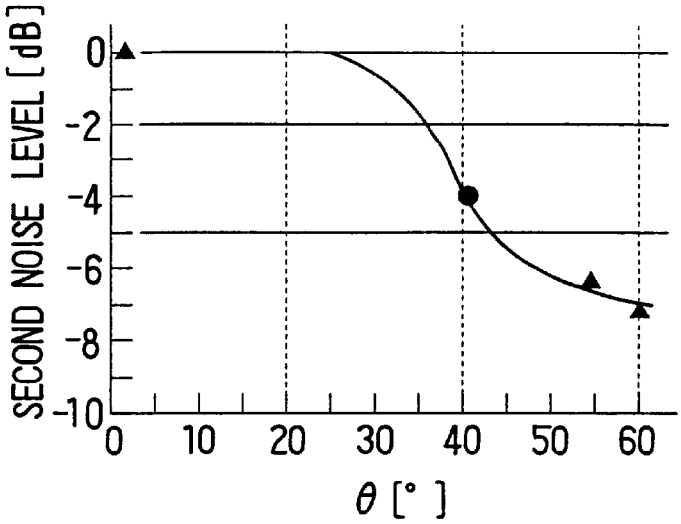
FIG. 5 is a graph showing the relationship between a slanting angle θ of a slanting portion and a peak level of second noise.

FIG. 5 shows the relationship between the slanting angle θ of the slanting portion 72*a* and a noise peak level of the second noise from the blower unit 7 mounted on a vehicle. In the first embodiment, the slanting angle θ can be set in a range of 25°–80° (i.e., $25° \leqq \theta \leqq 80°$). Preferably, the slanting angle θ is set in a range of 30°–60° (i.e., $30° \leqq \theta \leqq 60°$ ) to reduce the peak level of the second noise, as shown in FIG. 5. Here, the peak level of the second noise is a difference between a high position of a wave showing the second noise and a low position thereof.

Figure 6:
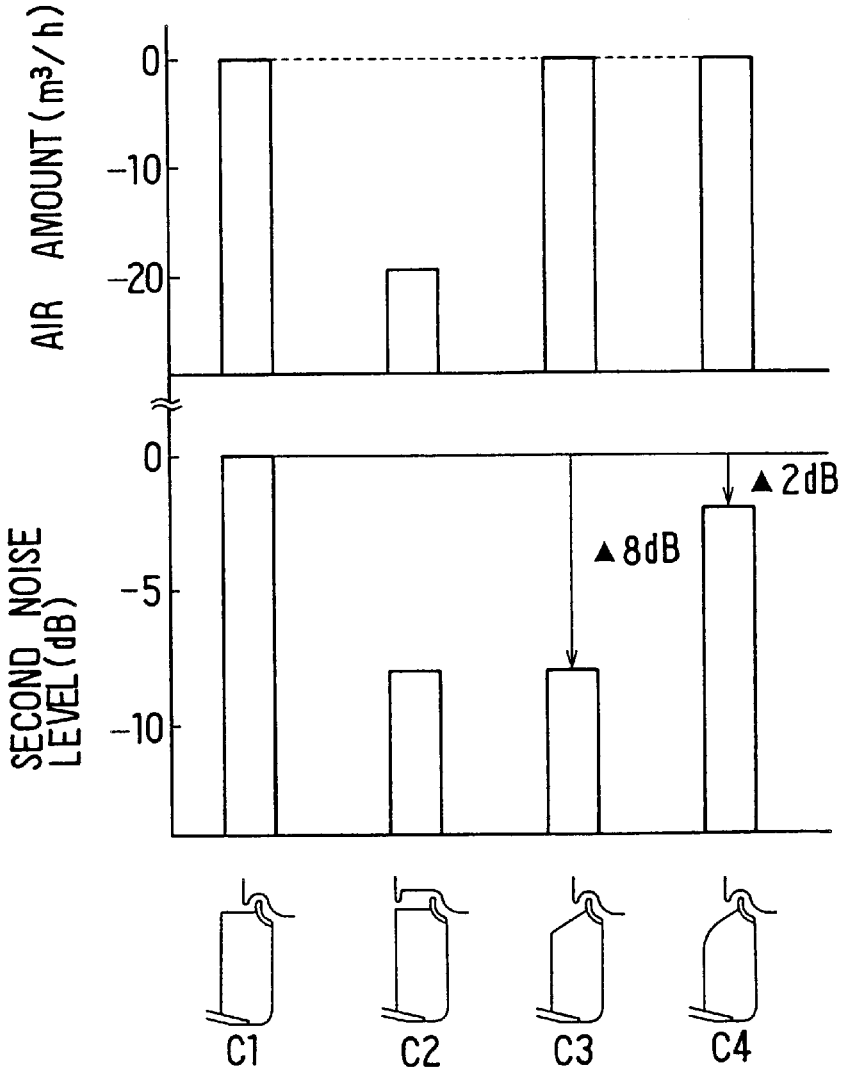
FIG. 6 is graphs relating to an air amount and a second noise level, for explaining effect of the first embodiment of the present invention.

Next, effect of the first embodiment of the present invention will be now described with reference to FIG. 6. In FIG. 6, C1 is a first comparison example in which the slanting portion 72*a* is not provided, C2 is a second comparison example in which entire ends of the blades 72 are covered by a casing, C3 is the first embodiment of the present invention, and C4 is a third comparison example in which the slanting portion 72*a* is formed into a circular arc shape. As shown in FIG. 6, in the first embodiment of the present invention, the second noise can be reduced to a level such as the second comparison example where the entire ends of the blades 72 are covered by a casing, while the air-blowing capacity can be increased sufficiently.

Figure 7:
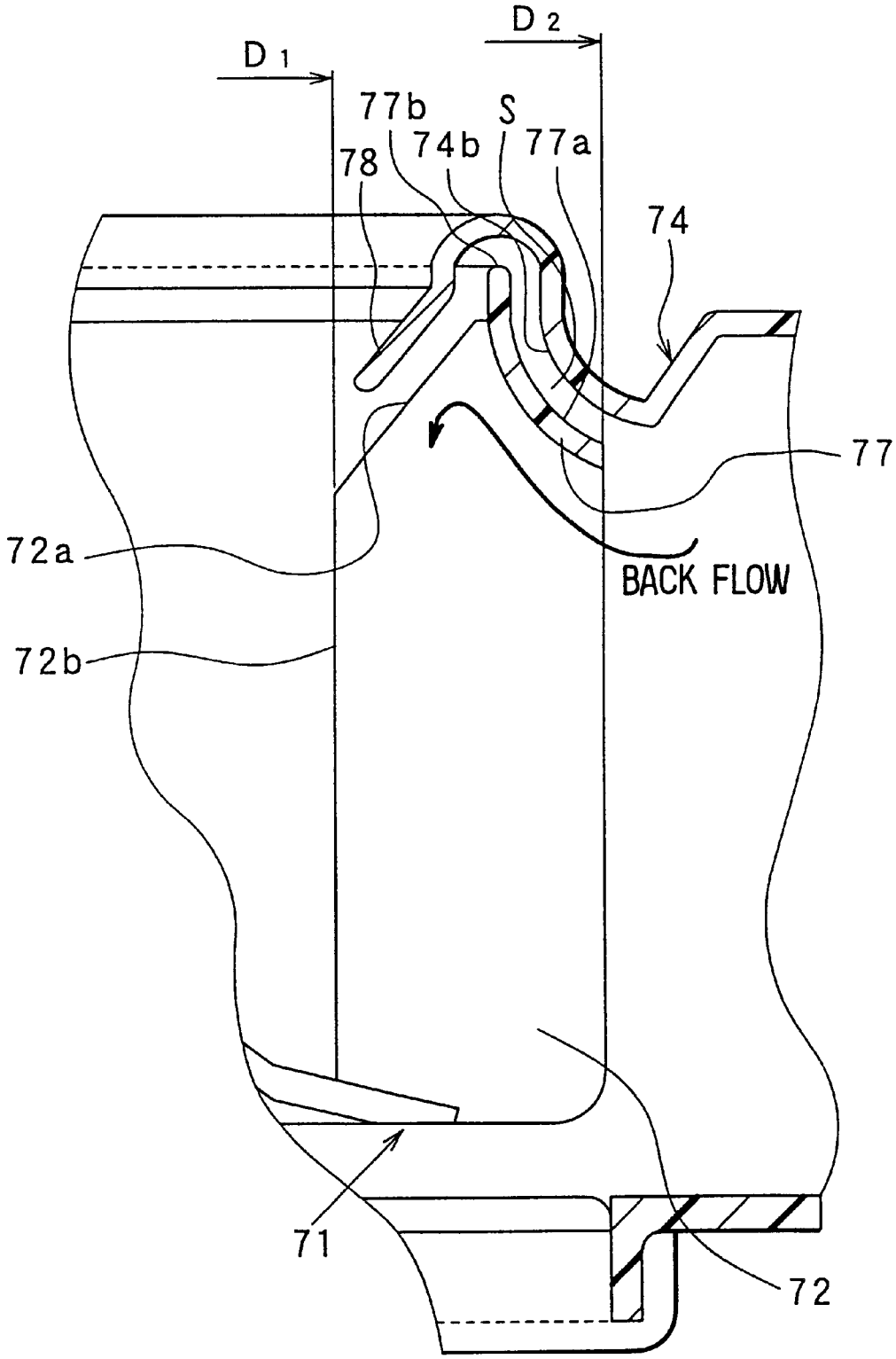
FIG. 7 is an enlarged view of a centrifugal type blower unit according to a second preferred embodiment of the present invention.
Figure 8:
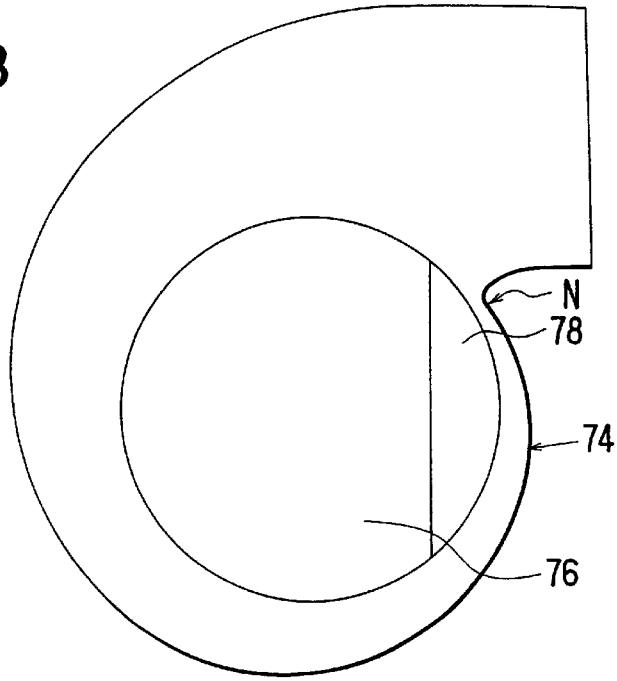
FIG. 8 is a schematic view of the blower unit of the second embodiment, when viewed from an air suction port side.

A second preferred embodiment of the present invention will be now described with reference to FIGS. 7 and 8. As shown in FIGS. 7 and 8, a covering member 78 for covering the slanting portion 72*a* is formed in the scroll casing 74 (i.e., bell-mouth portion 76) forming the air suction port 75 at a position corresponding to a nose portion N of the scroll casing 74. That is, at the position corresponding to the nose portion N in the radius direction of the centrifugal fan 71, the bell mouth portion 76 extends to the side of the electric motor 73 to cover the slanting portion 72*a* of the blades 72.

Air sucked from the air suction port 75 into the scroll casing 74 is accelerated between an inner radius end D1 and an outer radius end D2 of the centrifugal fan 71 by the blades 72, and is blown to a radius outside of the centrifugal fan 71. However, air introduced from the slanting portion 72*a* of the blades 72 is slightly accelerated by the blades 72, as compared with the other portion. Therefore, in the slanting portion 72*a* of the blades 72, back-flow air flowing from the outer radius end D2 to the inner radius end D1 of the centrifugal fan 71 may be generated. Therefore, an interference between the back-flow air and air sucked from the air suction port 75 may be caused, and a low-frequency noise (e.g., 10–500 Hz) may be readily caused during the foot mode or the defroster mode with a high pressure loss in the ventilation system of the air conditioner.

According to the second embodiment of the present invention, because the covering member 78 is provided to cover the slanting portion 72*a,* the interference between the backflow air and the suction air can be prevented, and the low-frequency noise can be reduced. Thus, in the second embodiment of the present invention, both of the second noise of the blower unit 7 and the low-frequency noise can be reduced. However, when the bell-mouth portion 76 extends over all peripherals of all the blades 72 at the air suction side, the air suction area of the centrifugal fan 71 is reduced, and air-blowing capacity of the blower unit 7 is reduced. According to the second embodiment of the present invention, the covering portion 78 is formed in the bell-mouth portion 76 at only the position corresponding to the nose portion N where the back-flow air is readily generated. Thus, in the second embodiment, both of the second noise and the low-frequency noise of the blower unit 7 can be reduced without greatly reducing the air-blowing capacity. In the second embodiment, the other portions are similar to those in the first embodiment, and the explanation thereof is omitted.

A third preferred embodiment of the present invention will be now described with reference to FIGS. 9 and 10.

Figure 9:
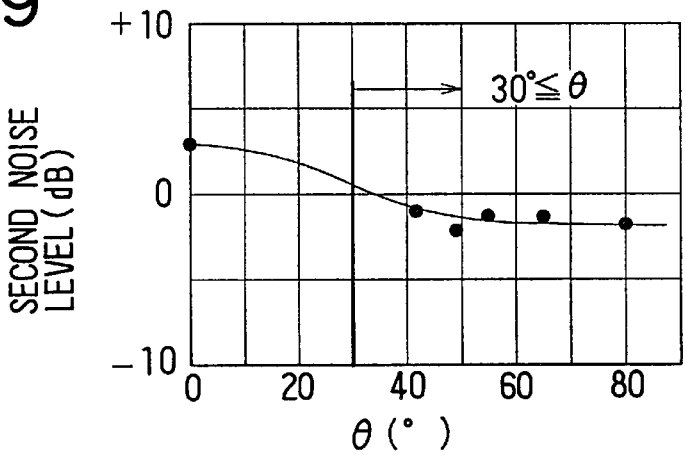
FIG. 9 is a graph showing the relationship between a slanting angle θ of a slating portion and a second noise level according to a third preferred embodiment of the present invention.
Figure 10:
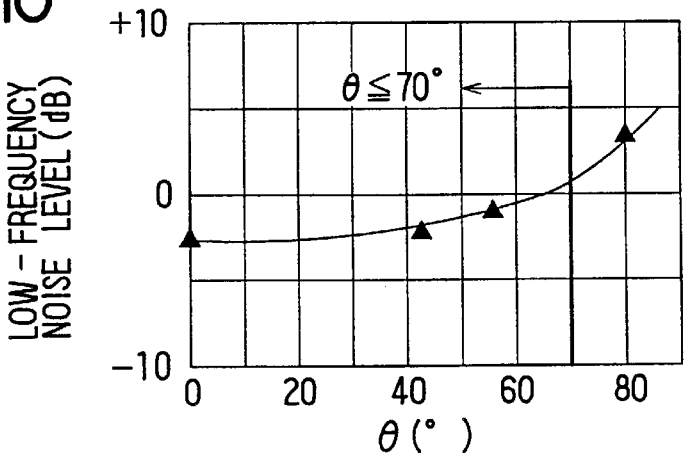
FIG. 10 is a graph showing the relationship between the slanting angle θ of the slating portion and a low-frequency noise level according to the third embodiment.

FIG. 9 shows the relationship between the slanting angle θ of the slanting portion 72*a* of the blades 72 and the second noise level, and FIG. 10 shows the relationship between slanting angle θ of the slanting portion 72*a* and the low-frequency noise level. As shown in FIG. 9, when the slanting angle θ of the slanting portion 72*a* is increased to be larger than 30°, the second noise can be reduced. However, as shown in FIG. 10, the low-frequency noise is increased as the slanting angle θ increases. Thus, according to a third embodiment of the present invention, the slanting angle θ is set in a range of 30°–70° (i.e., $30° \leqq \theta \leqq 70°$ ), thereby reducing both of the second noise and the low-frequency noise.

A fourth preferred embodiment of the present invention will be now described FIGS. 11–16. In the fourth embodiment of the present invention, the blower unit 7 is provided to reduce a low-frequency noise about 100–200 Hz while reducing consumption power.

In the fourth embodiment, the slanting portion 72*a* is formed in the blades 72 similarly to the first embodiment, and each of the blades 72 is formed in such a manner that curvature radius R1 from the inner radius end D1 of the centrifugal fan 71 to ¼ L position is smaller than curvature radius R2 from the outer radius end D2 of the centrifugal fan to ¾ L position. Here, "L" is a length subtracting an inner radius of the centrifugal fan 71 from an outer radius thereof. That is, the length L is the length of each blade 72 in the radius direction of the centrifugal fan 71.

In the centrifugal fan 71, the smaller a fan outlet angle β2 is, the larger the resistance applied to the blades 72 is. Therefore, consumption power of the electrical motor 73 for driving the centrifugal fan 71 is increased. That is, when the centrifugal fan outlet angle β2 becomes smaller, the blades 72 of the centrifugal fan are bent more toward the rotation direction F of the centrifugal fan 72. On the other hand, when the centrifugal fan outlet angle β2 becomes larger, the driving force of the centrifugal fan 71 is reduced. However, in this case, the air-blowing capacity of the blower unit 7 is also reduced.

Figure 11:
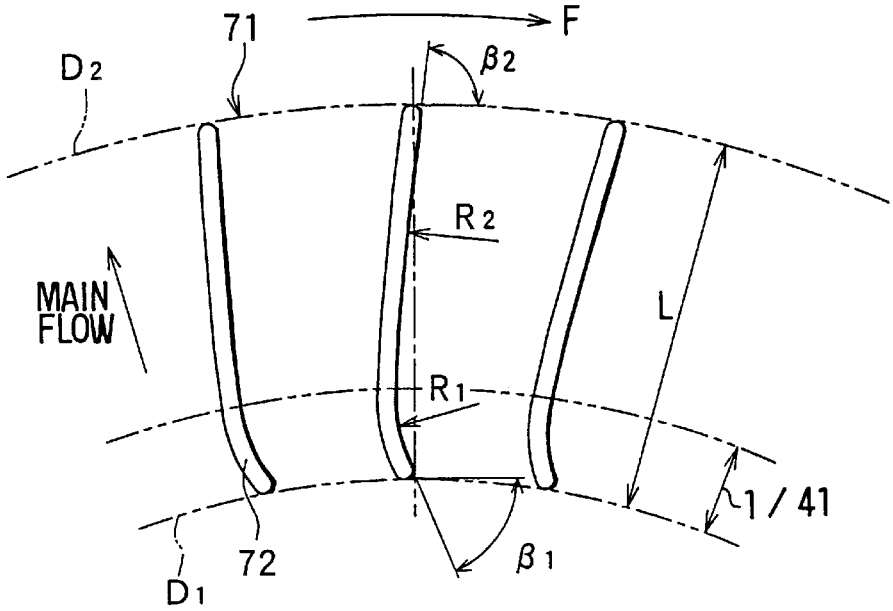
FIG. 11 is an enlarged view showing a part of a centrifugal fan of a centrifugal type blower unit according to a fourth preferred embodiment of the present invention.

Thus, it is necessary to suitably select the centrifugal fan outlet angle β2, to improve the air-blowing capacity and to reduce the driving force of the centrifugal fan 71. In the fourth embodiment, the centrifugal fan outlet angle β2 is approximately in a range of 80°–100°. As shown in FIG. 11, the centrifugal fan outlet angle β2 is a crossing angle between each blade 72 and an outer radius periphery of the centrifugal fan 71, measured from a rotation forward side of the centrifugal fan 71. On the other hand, a fan inlet angle β1 is a crossing angle between each blade 72 and an inner radius periphery of the centrifugal fan 71, measured from a rotation forward side of the centrifugal fan 71.

According to experiments by the inventors of the present invention, when the centrifugal fan inlet angle β1 becomes smaller, the low-frequency noise (e.g., noise about 100–200 Hz) becomes larger. On the other hand, when the centrifugal fan inlet angle β1 becomes larger, the low-frequency noise becomes smaller. However, in this case, the consumption power of the electrical motor 73 for driving the centrifugal fan 71 is increased.

Figure 12A:
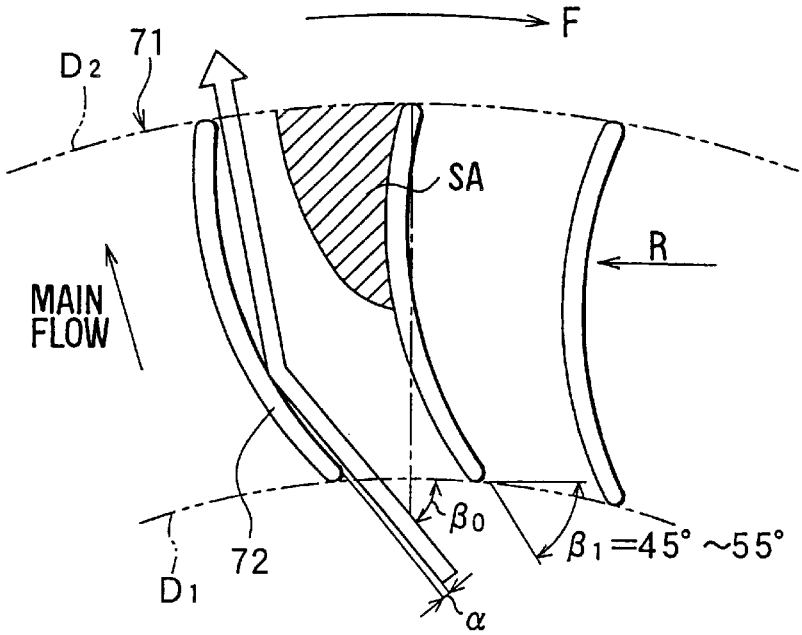
FIG. 12A is an enlarged view showing a part of a centrifugal fan having a constant curvature radius.
Figure 12B:
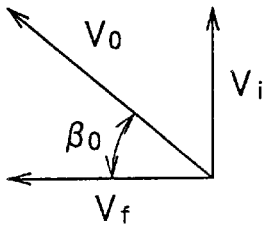
FIG. 12B is a vector diagram, according to the fourth embodiment.

The inventors of the present invention studied and examined the relationship between the centrifugal fan inlet angle β1 and the low-frequency noise. That is, air (hereinafter referred to as suction air Vo) sucked into the centrifugal fan 71 includes an air speed component Vi toward the radius outside of the centrifugal fan 71 and an air speed component Vf toward a direction opposite the rotation direction F of the centrifugal fan 71, as shown in FIG. 12B. Therefore, as shown in FIG. 12A, the suction air Vo flows into the centrifugal fan 71 by a predetermined inflow angle βo, and collides with the blades 72 so that the flow direction of air is changed to the radius outside. Here, the inflow angle βo is a crossing angle between the suction air Vo and the inner radius periphery of the centrifugal fan 71 when measured from a rotation forward side of the centrifugal fan 71. As shown in FIG. 12B, the larger the rotation speed of the centrifugal fan 71 is, the smaller the inflow angle βo of the suction air Vo.

Figure 13:
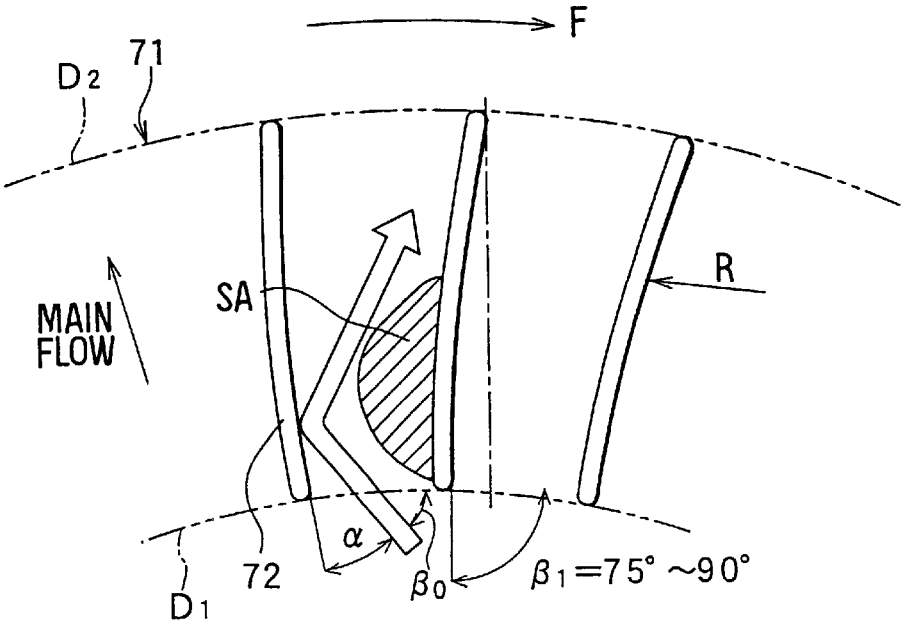
FIG. 13 is an enlarged view showing a part of a centrifugal fan having a constant curvature radius according to the fourth embodiment.

Further, because the centrifugal fan 71 rotates, the suction air Vo flows adjacent to the colliding blade 72 while being separated from a blade 72 at a direct rotation forward side of the colliding blade 72, as shown in FIG. 12A. Therefore, a separation area SA where air does not flow is formed. Here, the suction air Vo flows into the blades 72 of the centrifugal fan 71 by the predetermined inflow angle βo. Therefore, as shown in FIGS. 12A, 13, when the centrifugal fan inlet angle β1 becomes larger while curvature radius R of each blade 72 is constant, a separation point where the air flow is separated from the colliding blade is moved toward the inner radius end D1, and a re-attachment point where the separated suction air Vo is re-attached to the direct rotation forward side blade of the colliding blade 72 is also moved toward the inner radius end D1.

Thus, when the centrifugal fan inlet angle β1 becomes smaller while curvature radius of each blade 72 is constant, separated suction air Vo cannot be re-attached to a blade 72 between the inner radius end D1 and the outer radius end D2 of the centrifugal fan 71, and whirl generated with the separation of the suction air Vo is discharged to the radius outside with blown-air. Thus, the low-frequency noise (particularly, 100–200 Hz) is generated when the centrifugal fan inlet angle β1 becomes smaller.

When the centrifugal fan inlet angle β1 is made large while the curvature radius R of the blades 72 is constant, the re-attachment point is moved to the side of the inner radius end D1. Therefore, the separated suction air Vo is re-attached between the inner radius end D1 and the outer radius end D2, and whirl generated with the separation of the suction air Vo is not discharged to the radius outside of the centrifugal fan 71. However, when the centrifugal fan inlet angle β1 is made larger while the curvature radius R of each blade 72 is constant, a colliding angle α between the suction air Vo and the colliding blade 72 becomes larger. Therefore, colliding force vertically applied to a blade surface of the colliding blade 72 is increased. Thus, in this case, the driving force (consumption power of the electric motor 73) for driving the centrifugal fan 71 is increased. The colliding force is also increased according to an increase of the rotation speed of the centrifugal fan 71.

Figure 14:
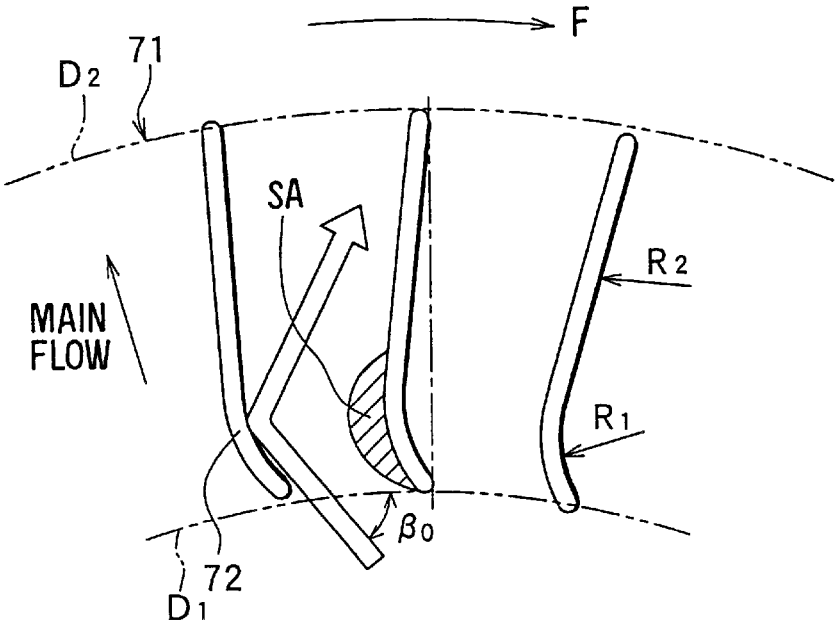
FIG. 14 is an enlarged view showing a part of the centrifugal fan according to the fourth embodiment.

According to the fourth embodiment of the present invention, the blades 72 are formed so that the curvature radius R1 at the side of the inner radius end D1 becomes smaller than curvature radius R2 at the side of the outer radius end D2. Therefore, as shown in FIG. 14, the separation point of the suction air Vo can be positioned at the side of the inner radius end D1, and the separated suction air Vo can be re-attached to the blade 72 between the inner radius end D1 and the outer radius end D2, while the colliding angle α can be made smaller. Thus, the low-frequency noise can be reduced while consumption power of the electrical motor 73 can be reduced.

Figure 15:
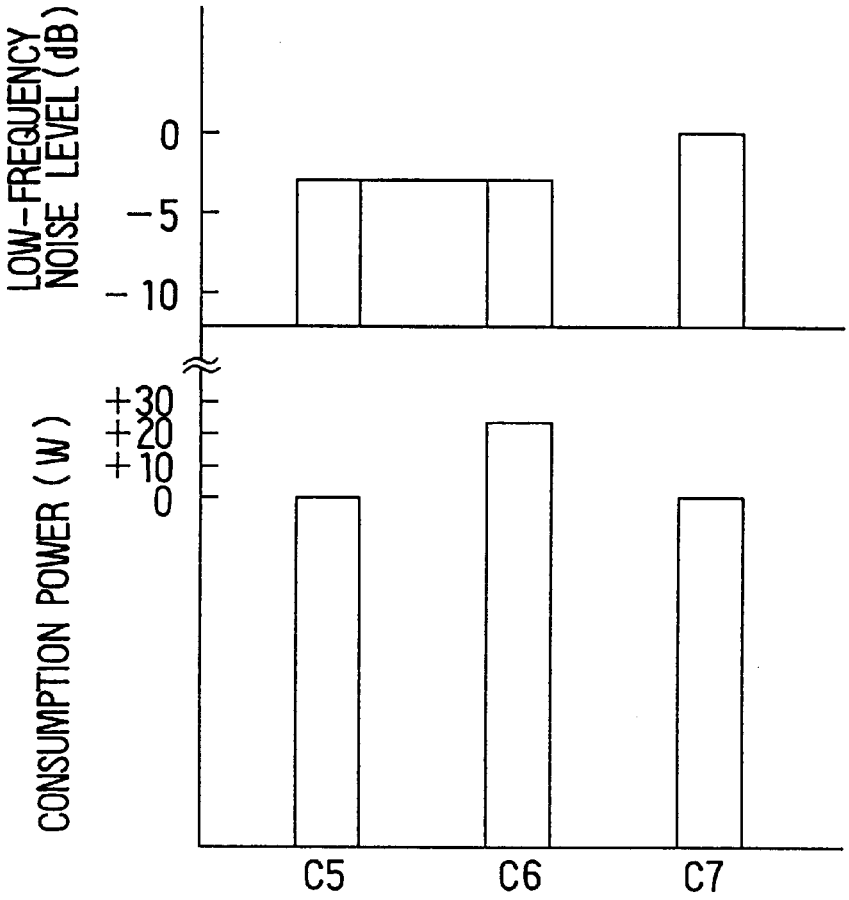
FIG. 15 is graphs relating to a low-frequency noise level and consumption power, for explaining the effect of the fourth embodiment of the present invention.

FIG. 15 shows the effect of the fourth embodiment of the present invention. In FIG. 15, noise is measured by a noise level measuring method of JIS-B-8346. In FIG. 15, C5 shows the fourth embodiment where the centrifugal fan inlet angle β1 is 55° and curvature radius R1 of the blades 72 at the side of the inner radius end D1 is set to be smaller than curvature radius R2 of blades 72 at the side of the outer radius end D2, C6 is a comparison example in which the β1 is 90° and the blades 72 are bent with a constant curvature radius R, and C7 is a comparison example in which the β1 is 55° and the blades 72 are bent with a constant curvature radius R. As shown in FIG. 15, in the fourth embodiment (C5) of the present invention, the low-frequency noise can be reduced while consumption power of the electrical motor 73 is reduced.

Figure 16:
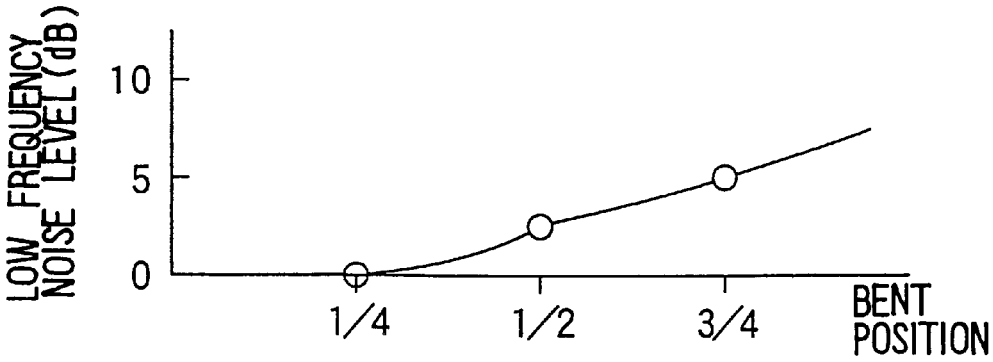
FIG. 16 is a graph showing the relationship between a bent position of each blade of the centrifugal fan and a low-frequency noise level according to the fourth embodiment.

When an area corresponding to the curvature radius R1 is increased, that is, when a bent position of each blade 72, separated from the inner radius end D1, is increased, the noise peak level of a low-frequency noise of 50–150 Hz is gradually increased, as shown in FIG. 16.

Thus, in the fourth preferred embodiment of the present invention, the bent position from the inner radius end D1 of the centrifugal fan 71 is set to be lower than ¼ L so that the separation point of the suction air Vo is prevented from being excessively moved to the side of the outer radius end D2. Further, a ratio of the curvature radius R1 at the side of the inner radius end D1 to the curvature radius R2 at the side of the outer radius end D2 is set to be equal to or lower than 0.2 (i.e., R1/R2≦0.2).

Although the present invention has been fully described in connection with preferred embodiments thereof with reference to the accompanying drawings, it is to be noted that various changes and modifications will become apparent to those skilled in the art.

For example, in each of the above-described embodiments, the blower unit 7 is applied to the air conditioner 1 of the vehicle. However, the blower unit 7 may be applied to any one ventilating system, for example.

Figure 17A:
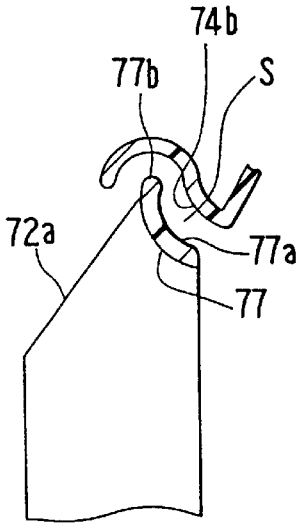
FIGS. 17A, 17B, 17C are enlarged views of slating portions according to a modification of the present invention.
Figure 17B:
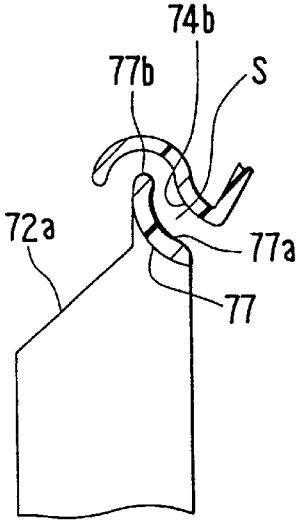
Figure 17C:
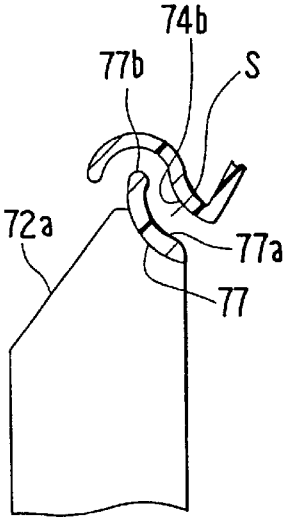

In the above-described embodiments, the parallel portion 72*b* formed in each blade 72 is approximately parallel to the rotation axis 7*a* so that the inner diameter of the centrifugal fan 71 is approximately constant. However, the parallel portion 72*b* may be slanted by an angle larger than the slanting angle θ. Further, the shape and the dimension of the slanting portion 72*a* may be changed as shown in FIGS. 17A–17C.

Figure 18:
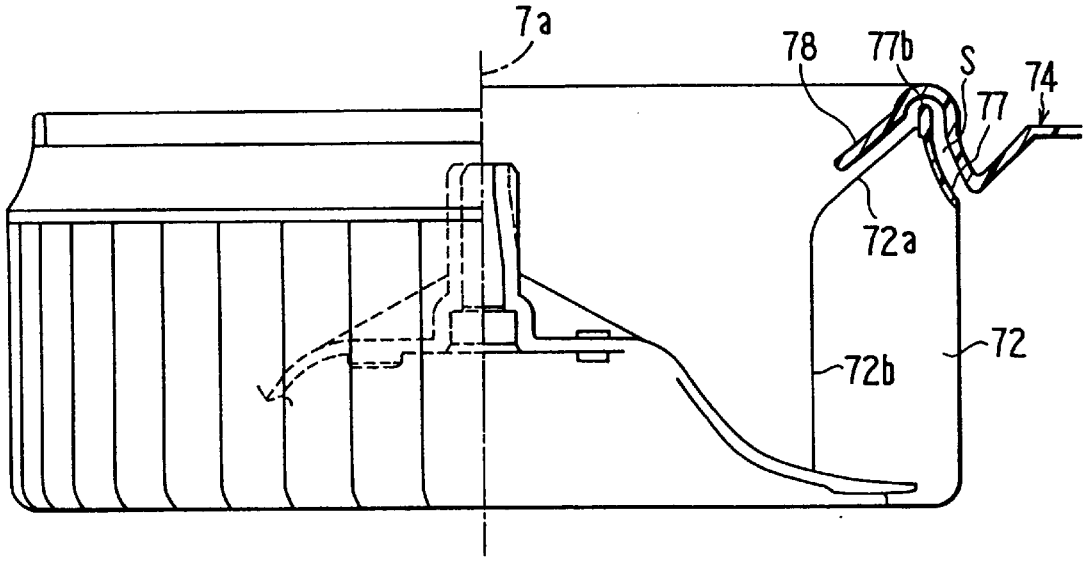
FIG. 18 is a schematic sectional view showing a centrifugal type blower unit according to an another modification of the present invention.
Figure 19:
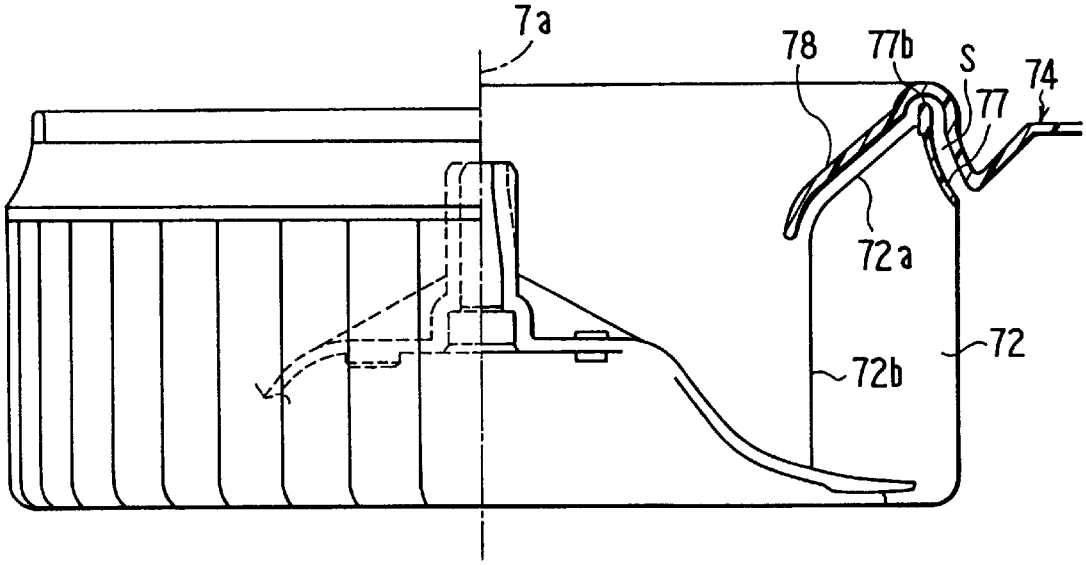
FIG. 19 is a schematic sectional view showing a centrifugal type blower unit according to an another modification of the present invention.
Figure 20:
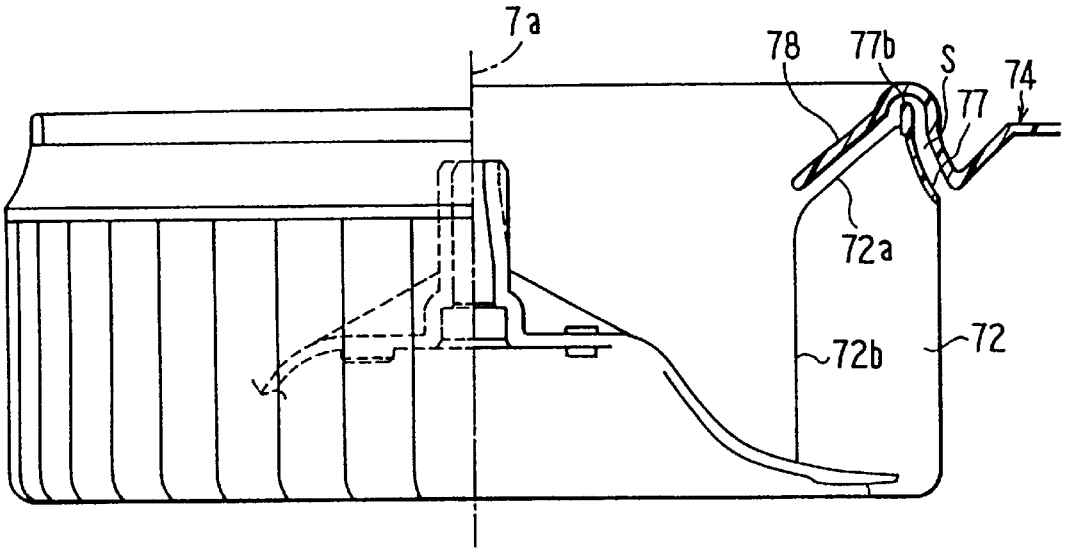
FIG. 20 is a schematic sectional view showing a centrifugal type blower unit according to an another modification of the present invention.
Figure 21:
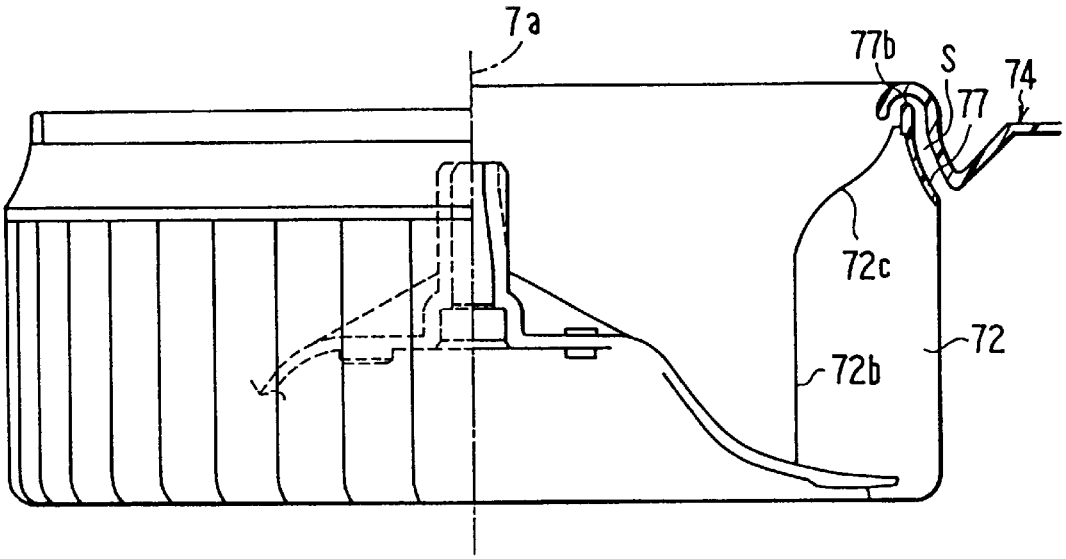
FIG. 21 is a schematic sectional view showing a centrifugal type blower unit according to an another modification of the present invention.
Figure 22:
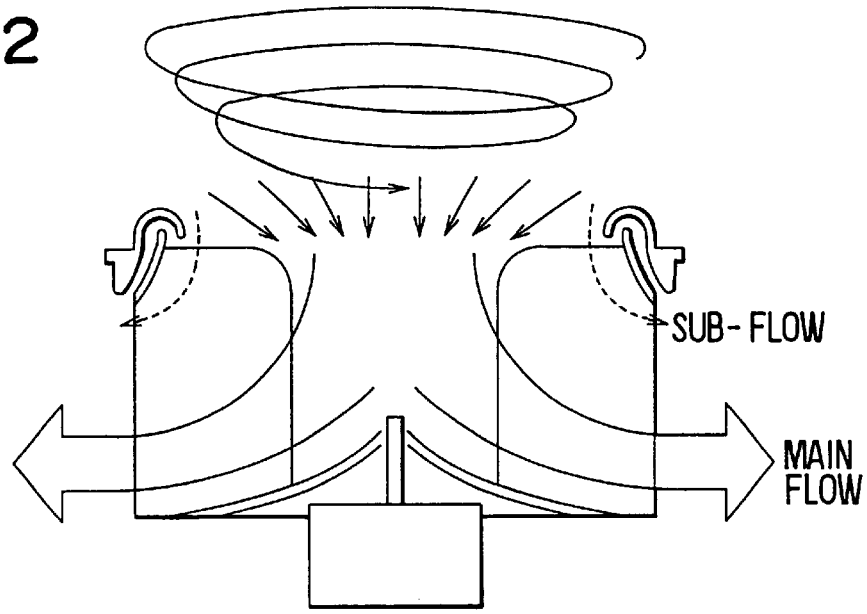
FIG. 22 is a schematic view for explaining second noise generated from a centrifugal type blower unit.
Figure 23:
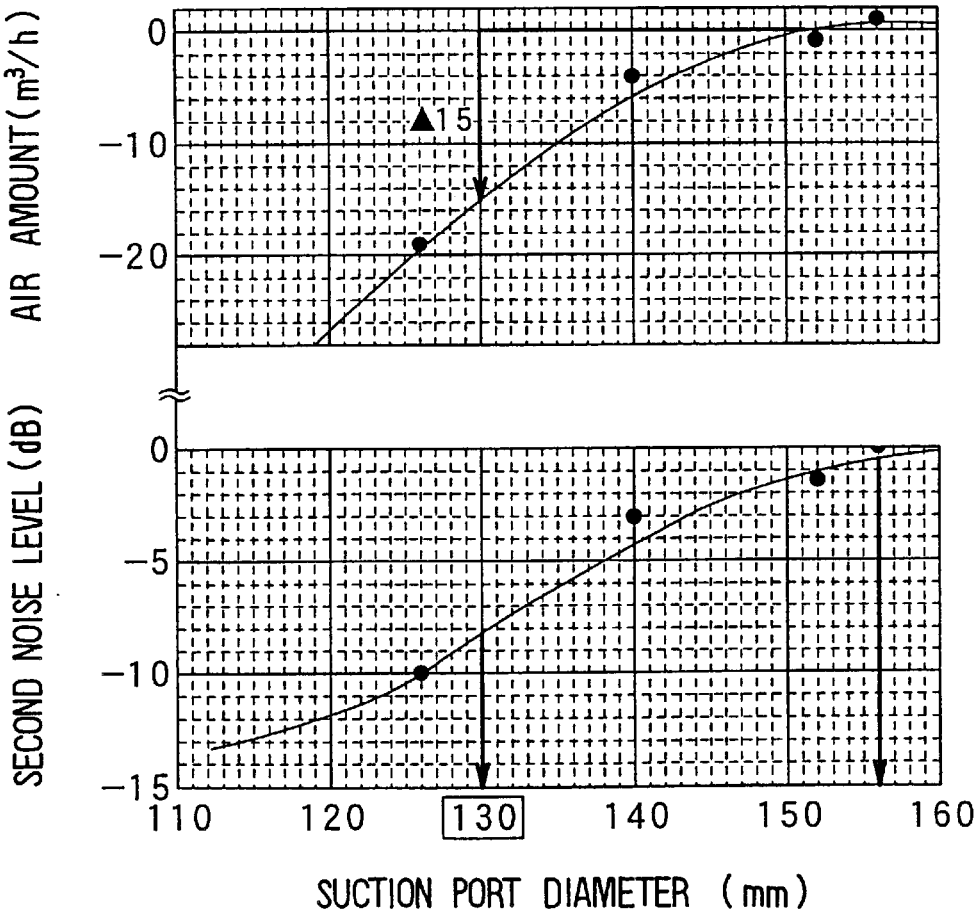
FIG. 23 is graphs showing the relationship between a diameter of an air suction port of a blower unit and an amount of air blown by the blower unit, and the relationship between the diameter of the air suction port and second noise generated from the blower unit.

In the above-described embodiments, the parallel portion 72*b* is directly connected to the slanting portion 72*a* by a predetermined angle therebetween. However, as shown in FIG. 18, the parallel portion 72*b* may be connected to the slanting portion 72*a* through a curve portion therebetween. In this case, an extending line of the parallel portion 72*b* and an extending line of the slanting portion 72*a* are crossed from each other. Further, the covering portion 78 may extend to the inner radius side of the centrifugal fan 71 to cover a part of the inner radius end of the centrifugal fan 71 as shown in FIG. 19, and may be formed to only cover all of the slanting portion 78, as shown in FIG. 20. Further, instead of the slanting portion 72*a,* a curve portion 72*c* having an inflection point may be used as shown in FIG. 21.

In the above-described embodiments, the ratio of the maximum inner diameter $d_{max}$ of each blade 72 to the opening diameter Ds of the air suction port 75 is set to be approximately 1.06. However, the ratio of the maximum inner diameter $d_{max}$ of each blade 72 to the opening diameter Ds of the air suction port 75 may be set to be equal to or larger than 0.9.

In the above-described embodiments, the filter 70 is disposed at an upstream air side of the blower unit 7. However, a foreign substance removing unit for removing a foreign substance having a relatively larger size may be disposed instead of the filter 70. Further, both of the filter 70 and the foreign substance removing unit may be omitted.

Further, in the above-described fourth embodiment, relative to each blade 72 having the slanting portion 72*a,* curvature radius R1 at the side of the inner radius end D1 is set to be difference to curvature radius R2 at the side of the outer radius end D2. However, relative to blades without the slanting portion 72*a,* curvature radius R1 at the side of the inner radius end D1 may be set to be difference to curvature radius R2 at the side of the outer radius end D2.

Such changes and modifications are to be understood as being within the scope of the present invention as defined by the appended claims.

What is claimed is:

1. A centrifugal type blower unit comprising:

a centrifugal fan having a rotation axis and a plurality of blades disposed around said rotation axis, said centrifugal fan blowing air sucked from an axial direction of said rotation axis toward a radial outward side; and a scroll casing for accommodating said centrifugal fan, said scroll casing forming an air passage through which air blown from said centrifugal fan flows, and having a suction port for sucking air from the axial direction at a side of the axial direction, wherein:

said suction port has a radius dimension in a radius direction of said centrifugal fan, said radius dimension of said suction port being larger than a minimum inner radius dimension of said centrifugal fan in said radius direction;

each of said blades has a slanting portion slanted relative to said radius direction by a predetermined slanting angle, and a constant portion approximately parallel to said axial direction; and said slanting portion is formed into a straight line shape in each blade of said centrifugal fan in such a manner that an inner radius dimension of said centrifugal fan in the radius direction is increased toward said suction port; and said slanting portion and said constant portion define each inner radius end of said blades in said radius direction, at least a portion of said slanting portion is positioned at an inner radial side of said suction port, and is slanted radially outside from said constant portion toward an axial end of each blade where said suction port is provided.

2. The centrifugal type blower unit according to claim 1, wherein said slanting angle is in a range of 25°–80°.

3. The centrifugal type blower unit according to claim 2, wherein said slanting angle is in a range of 30°–60°.

4. The centrifugal type blower unit according to claim 1, wherein said centrifugal fan has a maximum inner radios dimension in said radius direction at a side of said suction port, a ratio of said maximum inner radius dimension of said centrifugal fan to said radius dimension of said suction port is equal to or larger than 0.95.

5. The centrifugal type blower unit according to claim 1, wherein:

said scroll casing has a bell-mouth portion for forming said suction port; and said bell-mouth portion has a covering member which extends to a radius inner side of said centrifugal fan in said radius direction to cover at least a part of said slanting portion.

6. The centrifugal type blower unit according to claim 5, wherein:

said scroll casing has a nose portion protruding toward an inner side of said scroll casing in said radius direction; and said covering member is formed at a predetermined position corresponding to said nose portion.

7. The centrifugal type blower unit according to claim 1, wherein:

each of said blades has a first end at a radius inside, and a second end at a radius outside of said first end, in said radius direction;

each of said blades has a first curvature radius at a side of said first end, and a second curvature radius at a side of said second end; and said first curvature radius is smaller than said second curvature radius.

8. The centrifugal type blower unit according to claim 7, wherein:

each of said blades has a blade length in said radius direction; and said first curvature radius is for a first area of each blade, from said first end to about ¼ position of said blade length.

9. The centrifugal type blower unit according to claim 1, wherein:

said slanting portion is disposed adjacent to said suction port; and said slanting portion is directly connected to said constant portion by a predetermined cross angle therebetween.

10. The centrifugal type blower unit according to claim 1, wherein:

said slanting portion is disposed adjacent to said suction port; and said slanting portion is connected to said constant portion via a curve portion therebetween so that an extending line of said slanting portion and an extending line of the constant portion are crossed from each other by a predetermined cross angle.

11. The centrifugal type blower unit according to claim 1, further comprising a foreign substance removing unit for removing a foreign substance contained in air, wherein said foreign substance removing unit is disposed at an upstream air side of said suction port at a position proximate to said suction port, to prevent the foreign substance from being sucked into said suction port.

12. The centrifugal type blower unit according to claim 1, further comprising a foreign substance removing unit for removing a foreign substance contained in air, wherein said foreign substance removing unit is disposed at an upstream air side of said suction port at a position proximate to said suction port, to prevent the foreign substance from being sucked into said suction port.

13. A centrifugal type blower unit comprising:

a centrifugal fan having a rotation axis and a plurality of blades disposed around said rotation axis, said centrifugal fan blowing air sucked from an axial direction of said rotation axis toward a radial outward side; and a scroll casing for accommodating said centrifugal fan, said scroll casing forming an air passage through which air blown from said centrifugal fan flows, and having a suction port for sucking air from the axial direction at a side of the axial direction, wherein;

said suction port has a radius dimension in a radius direction of said centrifugal fan, said radius dimension of said suction port being larger than a minimum inner radius dimension of said centrifugal fan in said radius direction;

each of said blades has a slanting portion slanted relative to said radius direction by a predetermined slanting angle, and a constant portion approximately parallel to said axial direction;

said slanting portion is formed in each blade of said centrifugal fan in such a manner that an inner radius dimension of said centrifugal fan in the radius direction is increased toward said suction port;

said scroll casing has a bell-mouth portion for forming said suction port;

said bell-mouth portion has a covering member which extends to a radius inner side of said centrifugal fan in said radius direction to cover at least a part of said slanting portion; and said covering member extends to a radius inner end of said centrifugal fan.

14. A centrifugal type blower unit comprising:

a centrifugal fan having a rotation axis and a plurality of blades disposed around said rotation axis, said centrifugal fan blowing air sucked from an axial direction of said rotation axis toward a radial outward side; and a scroll casing for accommodating said centrifugal fan, said scroll casing forming an air passage through which air blown from said centrifugal fan flows, and having a suction port for sucking air from the axial direction at a side of the axial direction, wherein:

said suction port has a radius dimension in a radius direction of said centrifugal fan, said radius dimension of said suction port being larger than a minimum inner radius dimension of said centrifugal fan in said radius direction;

each of said blades has a slanting portion slanted relative to said radius direction by a predetermined slanting angle, and a constant portion approximately parallel to said axial direction;

said slanting portion is formed in each blade of said centrifugal fan in such a manner that an inner radius dimension of said centrifugal fan in the radius direction is increased toward said suction port;

each of said blades has a first end at a radius inside, and a second end at a radius outside of said first end, in said radius direction;

each of said blades has a first curvature radius at a side of said first end, and a second curvature radius at a side of said second end;

said first curvature radius is smaller than said second curvature radius; and a ratio of said first curvature radius to said second curvature radius is equal to or less than 0.2.

15. A centrifugal type blower unit comprising:

a centrifugal fan having a rotation axis and a plurality of blades disposed around said rotation axis, said centrifugal fan blowing air sucked from an axial direction of said rotation axis toward a radial outward side; and a scroll casing for accommodating said centrifugal fan, said scroll casing having a suction port for sucking air from the axial direction at a side of the axial direction, wherein:

said suction port has a radius dimension in a radius direction of said centrifugal fan, said radius dimension of said suction port being larger than a minimum inner radius dimension of said centrifugal fan in said radius direction;

each of said blades has a constant portion approximately parallel to said axial direction, and a curve portion connected to said constant portion; and said curve portion has at least an inflection point, and is formed adjacent to said suction port in each blade of said centrifugal fan in such a manner that an inner radius dimension of said centrifugal fan in the radius direction is increased toward said suction port.

16. The centrifugal type blower unit according to claim 15, wherein:

said scroll casing has a bell-mouth portion for forming said suction port; and said bell-mouth portion has a covering member which extends to a radius inner side of said centrifugal fan in said radius direction to cover at least a part of said curve portion.

17. The centrifugal type blower unit according to claim 15, wherein:

said curve portion has a first end connected to said constant portion and a second end at a side of said suction port; and said curve portion is connected to said constant portion in such a manner that an extending line connecting said first end and said second end of said curve portion is crossed with an extending line of said constant portion by a predetermined cross angle.

18. A centrifugal type blower unit comprising:

a centrifugal fan having a rotation axis and a plurality of blades disposed around said rotation axis, said centrifugal fan blowing air sucked from an axial direction of said rotation axis toward a radial outward side; and a scroll casing for accommodating said centrifugal fan, said scroll casing forming an air passage through which air blown from said centrifugal fan flows, and having a suction port for sucking air from the axial direction at a side of the axial direction, wherein:

said suction port has a radius dimension in a radius direction of said centrifugal fan, said radius dimension of said suction port being larger than a minimum inner radius dimension of said centrifugal fan in said radius direction;

each of said blades has a slanting portion slanted relative to said radius direction by a predetermined slanting angle, and a constant portion approximately parallel to said axial direction;

said slanting portion is formed into each blade of said centrifugal fan in such a manner that an inner radius dimension of said centrifugal fan in the radius direction is increased toward said suction port;

said slanting portion and said constant portion define each inner radius end of said blades in the radius direction; and said slanting portion is recessed from said constant portion into a radius outer side.

19. The centrifugal type blower unit according to claim 18, wherein said slanting portion is provided from the constant portion to an axial end of each blade at a side where said suction port is provided.

20. The centrifugal type blower unit according to claim 18, wherein said slanting angle is in a range of 25°–80°.

21. The centrifugal type blower unit according to claim 20, wherein said slanting angle is in a range of 30°–60°.

22. The centrifugal type blower unit according to claim 18, wherein said centrifugal fan has a maximum inner radius dimension in said radius direction at a side of said suction port, a ratio of said maximum inner radius dimension of said centrifugal fan to said radius dimension of said suction port is equal to or larger than 0.95.

23. The centrifugal type blower unit according to claim 18, wherein:

said scroll casing has a bell-mouth portion for forming said suction port; and said bell-mouth portion has a covering member which extends to a radius inner side of said centrifugal fan in said radius direction to cover at least a part of said slanting portion.

24. The centrifugal type blower unit according to claim 23, wherein:

said scroll casing has a nose portion protruding toward an inner side of said scroll casing in said radius direction; and said covering member is formed at a predetermined position corresponding to said nose portion.

25. The centrifugal type blower unit according to claim 18, wherein:

each of said blades has a first end at a radius inside, and a second end at a radius outside of said first end, in said radius direction;

each of said blades has a first curvature radius at a side of said first end, and a second curvature radius at a side of said second end; and said first curvature radius is smaller than said second curvature radius.

26. The centrifugal type blower unit according to claim 25, wherein:

each of said blades has a blade length in said radius direction; and said first curvature radius is for a first area of each blade, from said first end to about ¼ position of said blade length.

27. The centrifugal type blower unit according to claim 18, wherein:

said slanting portion is disposed adjacent to said suction port; and said slanting portion is directly connected to said constant portion by a predetermined cross angle therebetween.

28. The centrifugal type blower unit according to claim 18, wherein:

said slanting portion is disposed adjacent to said suction port; and said slanting portion is connected to said constant portion via a curve portion therebetween so that an extending line of said slanting portion and an extending line of the constant portion are crossed from each other by a predetermined cross angle.

* * * * *